US005949448A

United States Patent [19]

Man et al.

[11] Patent Number: 5,949,448

[45] Date of Patent: Sep. 7, 1999

[54] FIBER CLEANING SYSTEM FOR INKJET PRINTHEAD WIPERS

[75] Inventors: Xiuting C Man, Vancouver; Nicholas R Manwell, Camas; Jack L Burkman, Vancouver, all of Wash.

[73] Assignee: Hewlett-Packard Company, Palo Alto, Calif.

[21] Appl. No.: 08/791,712

[22] Filed: Jan. 31, 1997

[51] Int. Cl.[6] ..... B41J 2/165

[52] U.S. Cl. ..... 347/33; 347/34

[58] Field of Search ..... 347/33, 34

[56] References Cited

U.S. PATENT DOCUMENTS

| | | | |
|---|---|---|---|
| 4,306,245 | 12/1981 | Kasugayama et al. | 346/140 |
| 4,340,897 | 7/1982 | Miller | 346/140 |
| 5,005,024 | 4/1991 | Takahashi et al. | 346/1.1 |
| 5,051,758 | 9/1991 | Markham | 346/140 |
| 5,557,306 | 9/1996 | Fukushima et al. | 347/33 |

FOREIGN PATENT DOCUMENTS

| | | | |
|---|---|---|---|
| 0437361A1 | 7/1991 | European Pat. Off. | B41J 2/165 |
| 0494693A1 | 7/1992 | European Pat. Off. | B41J 2/165 |
| 63-113553 | 5/1987 | Japan | 347/33 |
| 6-143597 | 5/1994 | Japan | B41J 2/165 |
| WO88/08370 | 11/1988 | WIPO | B41J 3/03 |

*Primary Examiner*—Valerie Lund
*Attorney, Agent, or Firm*—Flory L. Martin

[57] ABSTRACT

A fiber wiper cleaning system is provided for removing ink residue from a wiper after wiping an inkjet printhead in an inkjet printing mechanism. A service station supports the wiper while removing ink residue from the printhead through relative motion of the wiper and printhead. The service station has a fiber wiper cleaner that contacts and cleans the wiper to present the printhead with a fresh wiping surface during the next wiping stroke. Any auxiliary flaps used to clean areas adjacent the printhead are also cleaned using this system. Interaction of the wiper and cleaner pumps ink residue from between the cleaner fibers to ready the fibers for the next cleaning cycle. An inkjet printing mechanism having such a fiber wiper cleaning system is also provided, along with a method of wiping accumulated ink residue from an inkjet printhead installed in an inkjet printing mechanism.

23 Claims, 5 Drawing Sheets

FIBER CLEANING SYSTEM FOR INKJET PRINTHEAD WIPERS

FIELD OF THE INVENTION

The present invention relates generally to inkjet printing mechanisms, and more particularly to a fiber cleaning system for removing ink residue from a wiper used to clean an inkjet printhead.

BACKGROUND OF THE INVENTION

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved by either moving the printhead across the wiper, or moving the wiper across the printhead.

To improve the clarity and contrast of the printed image, recent research has focused on improving the ink itself To provide quicker, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. With the earlier dye-based inks, periodically wiping the printhead with an elastomeric wiper was sufficient. However, with the advent of the pigment-based inks, a secondary operation of cleaning the wiper has become necessary to remove sticky pigment ink residue from the wiper. In the early printers using these pigment based inks, this secondary wiper cleaning operation was accomplished using a rigid plastic scrapper bar. Through relative motion of either the scrapper, the wiper blade, or both, the wiper was scrapped across the rigid scraper bar to remove ink from the surfaces of the wiper blade. For instance, one earlier wiper scraper system used in the DeskJet® 850C, 855C, 820C and 870C models of inkjet printers, produced by the Hewlett-Packard Company of Palo Alto, Calif., required intricate ink wicking channels to draw the liquid portions of the ink away from the main scrapper surface and into an absorbent ink blotter member.

Unfortunately, the pigment-based ink residue often accumulated on the wiper surface in the form of a paste, which the earlier plastic scrapper was not totally effective in removing. Instead, when encountering this paste-like consistency of ink residue, the plastic scrapper tended to smear the ink on the surface of the wiper, rather than removing the residue. Another disadvantage of the plastic scrapper is believed to be wear on the wiper, with the scrapper actually removing fine microlayers or otherwise pitting and damaging the wiper surface. Another drawback of the plastic scrapper is the tendency of the wiper blade when moving past the scrapper to flick ink off of the cleaning surface. This ink splatter or flicking action propelled the ink residue to other areas and components inside the printer service station, dirtying any surfaces where it landed. Additionally, the plastic scrapper system typically provided only two cleaning surfaces for the wiper, assuming that the wiper moved reciprocally back and forth across the scrapper. Finally, one of the major annoyances of the rigid wiper scrapers was the aggravating noise generated by the wiper scraping process.

Thus, a need exists for an inkjet printhead wiping system including a wiper cleaner capable of accommodating both fast drying dye-based and pigment-based inks, which is quiet, insensitive to paste-like ink build-up on the wiper, which minimizes wiper wear and ink flicking from the wiper blade, and which provides an expanded cleaning surface for the wiper.

SUMMARY OF THE INVENTION

According to one aspect of the present invention, a fiber cleaning system is provided for removing ink residue from a wiper after wiping an inkjet printhead in an inkjet printing mechanism having a chassis. The cleaning system includes a service station supported by the printing mechanism chassis, and a wiper supported by the service station to selectively contact and wipe the printhead to remove any ink residue from the printhead. The cleaning system also has a fiber cleaner supported by the service station to selectively contact and clean the wiper to remove any ink residue, with the fiber cleaner having plural fibers. In one illustrated embodiment, the fibers are straight bristles, in another embodiment the fibers are curly and intertwined, whereas in another embodiment, the fibers are presented to the wipers as loops.

According to yet another aspect of the present invention, an inkjet printing mechanism may be provided with the fiber cleaning system described above.

According to another aspect of the present invention, a method is provided for wiping accumulated ink residue from an inkjet printhead in an inkjet printing mechanism. The method includes the steps of ejecting ink though the inkjet printhead and accumulating ink residue thereon. In a wiping step, the accumulated ink residue is wiped from the printhead using a wiper. After the wiping step, in a cleaning step, the wiper is cleaned with a fiber cleaner through relative motion of the wiper and cleaner, with the fiber cleaner having plural fibers at least some of which engage the wiper.

An overall goal of the present invention is to provide an inkjet printing mechanism which prints sharp vivid images, particularly when using fast drying pigment or dye based inks.

Another goal of the present invention is to provide a robust wiping system capable of reliably cleaning the nozzle face plate of an inkjet printhead with a clean wiper, whether the printhead dispenses a dye-based ink or a pigment-based ink.

DETAILED DESCRIPTION OF A PREFERRED EMBODIMENT

Figure 1:
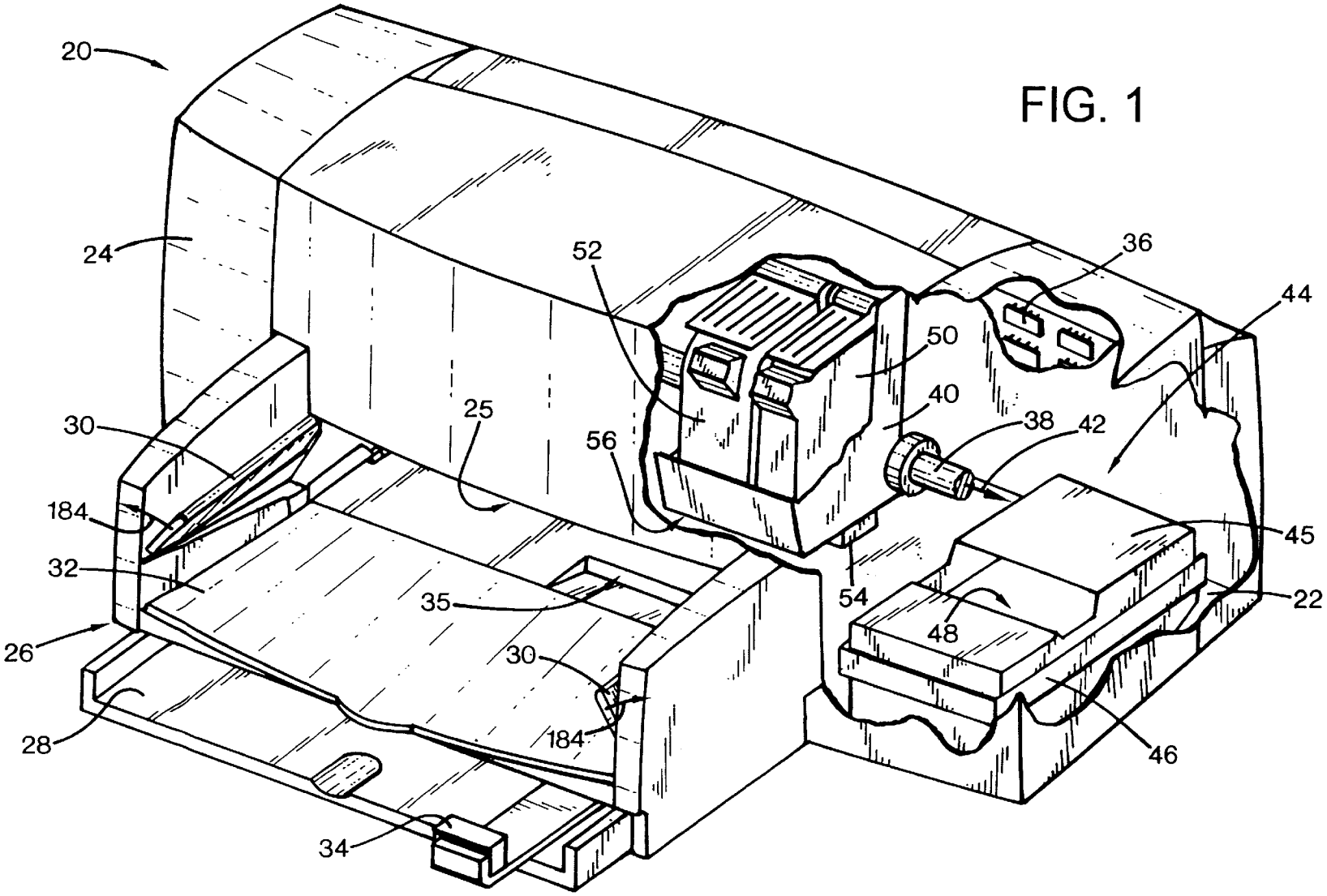
FIG. 1 is a perspective view of one form of an inkjet printing mechanism, here, an inkjet printer, including a printhead service station having one form of a fiber cleaning system of the present invention for cleaning inkjet printhead wipers.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a print zone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the print zone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the print zone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, a conventional optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various printhead servicing functions. For example, a service station frame 46 holds a group of printhead servicing appliances, described in greater detail below. In FIG. 1, a spittoon portion 48 of the service station is shown as being defined, at least in part, by the service station frame 46.

In the print zone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the print zone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56.

Figure 2:
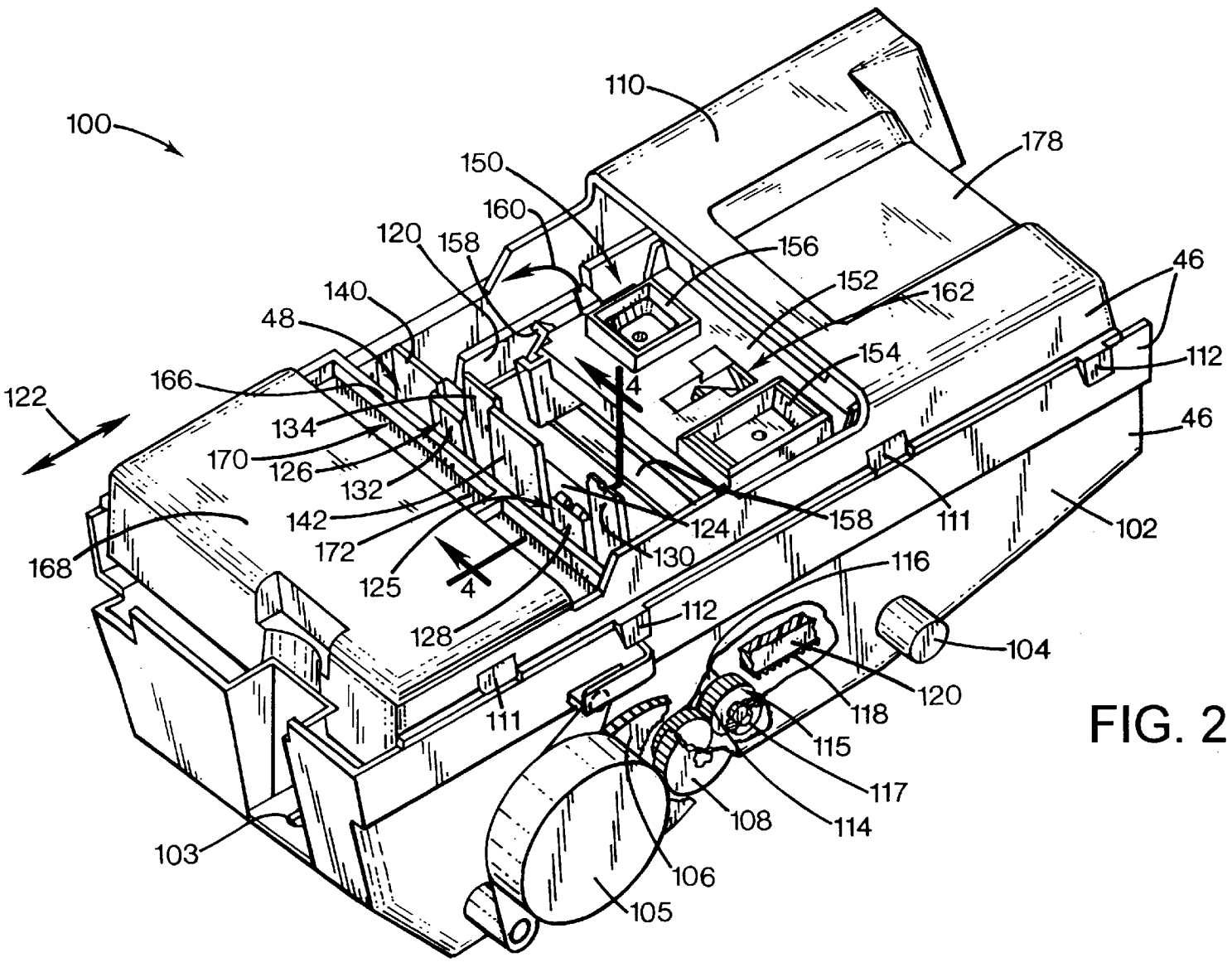
FIG. 2 is an enlarged perspective view of the service station of FIG. 1.

FIG. 2 illustrates a preferred embodiment of a transitional service station system 100 constructed in accordance with the present invention. Here, the service station frame 46 includes a base member 102 which may be attached to the printer chassis 22, for instance using a snap fastener, a rivet, a screw or other fastening device inserted through a slotted hole 103 defined by a front portion of the base 102. To adjust the elevation of the printhead servicing components, an adjustment mechanism (not shown) may be used to engage the frame, for instance using a pair of posts extending outwardly from opposite sides of the frame base 102, such as adjustment post 104. As described further below, the frame base 102 also advantageously serves as the spittoon 48, shown in FIG. 1.

The chassis 22, or more preferably the exterior of the base 102, may be used to support a conventional service station drive motor, such as a stepper motor 105. The stepper motor 105 is operatively engaged to drive a first transfer gear 106, using one or more reduction gears, belts, or other drive means known to those skilled in the art, here shown driving a second transfer gear 108. Both the first and second transfer gears 106, 108 are preferably mounted to posts extending from the outboard side of the base 102. Finally, to complete the service station frame 46, an upper portion or bonnet 110 of the frame 46 is secured to the frame base 102, preferably using snap hooks 111 and tapered guides 112.

The transfer gear 108 engages one of a pair of drive gears 114 of a spindle pinion drive gear assembly 115. The pair of pinion gears 114 reside along opposite sides of the service station frame 102, and are coupled together by an axle portion 116. The axle 116 of the spindle pinion gear 115 is supported by a pair of bearing mounts, such as bearing mount 117 in FIG. 2, shown extending from the interior of the frame base 102. The pair of gears 114 each engage respective pairs of rack gears 118 formed along a lower surface of a translationally movable pallet 120 to move the pallet in the directions indicated by double-headed arrow 122.

The pallet 120 includes a wiper support 124, preferably located toward the front end of the pallet. Mounted along the upper surface of the wiper support 124 are black and color printhead wiper assemblies 125, 126 for orthogonally wiping the orifice plates of the respective black and color printheads 54, 56. The illustrated black ink wiper 125 is designed to efficiently clean the black printhead 54 by using two upright spaced-apart, mutually parallel blade portions 128 and 130, each having special tip contours. The color ink wiper assembly 126 may also have two spaced-apart, mutually parallel upright blade portions 132 and 134 for wiping the color pen 52, here, containing three dye based inks of cyan, magenta, and yellow, for instance. Suitable black and color wiper assemblies having the configurations shown for the assemblies 125 and 126 are sold in the DeskJet® 850C, 855C, 820C and 870C models of inkjet printers, produced by the Hewlett-Packard Company of Palo Alto, Calif. The wiper blades 128–134 may be joined to the platform 124 in any conventional manner, such as by bonding with adhesives, sonic welding, or more preferably by onsert molding techniques, where the base of the wiper blade extends through holes formed within platform 124. In the illustrated embodiment, the wiper blades 128–134 are each of a non-abrasive resilient material, such as an elastomer or plastic, a nitrile rubber or other rubber-like material, but preferably of an ethylene polypropylene diene monomer (EPDM), or other comparable material known to those skilled in the art.

In the illustrated embodiment, the black pen 50 contains a pigment based ink which generates a gummy residue wiper that resists wiping using a conventional wiper, as described in the Background portion above. Each of the black wiper blades 128 and 130 terminate in a wiping tip at their distal end. Preferably the wiping tips have a forked geometry, with the number of fork tongs equal to the number of linear nozzle arrays on the corresponding printhead, here two fork tongs for the two linear nozzle arrays of printhead 54. Thus, the wiper blades 128, 130 each have a pair of wiping tips that are separated by a recessed flat land portion and each flanked on their outboard sides by recessed flat land portions. The color wiper blades 132 and 134 may be constructed as described above for the black wiper blades 128, 130, but preferably without the fork tongs and escape recesses.

In the illustrated embodiment, both the color wiper blades 132, 134 and the wiper tips of the black blades 128, 130 each have an outboard rounded edge adjacent the outboard surfaces of the blades. Opposite each rounded wiping edge, the wiping tips of blades 128–134 may terminate angularly, or more preferably, in a square edge adjacent the inboard surfaces of the blades. The rounded edges assist in forming a capillary channel between the blade and the nozzle orifice plate to wick ink from the nozzles as the wipers move orthogonally along the length of the nozzle arrays. This wicked ink is pulled by the outboard rounded edge of the leading wiper blade to the next nozzle in the array, where it acts as a solvent to dissolve dried ink residue accumulated on the printhead face plate. The inboard angular edge of the trailing wiper blade then scrapes the dissolved residue from the printhead face plate. That is, when the platform is retreating toward the rear of the printer (to the right in the view of FIG. 2), the black blade 130 and the color blade 134 are the leading blades that wick ink with their rounded outboard edges, while blades 128 and 132 are the trailing blades, scraping away residue with their inboard angular edges.

For convenience, all of the wiper black wiper blades 128, 130 and color wiper blades 132, 134 will be referred to herein collectively as wipers 125, 126, unless otherwise noted.

Figure 3:
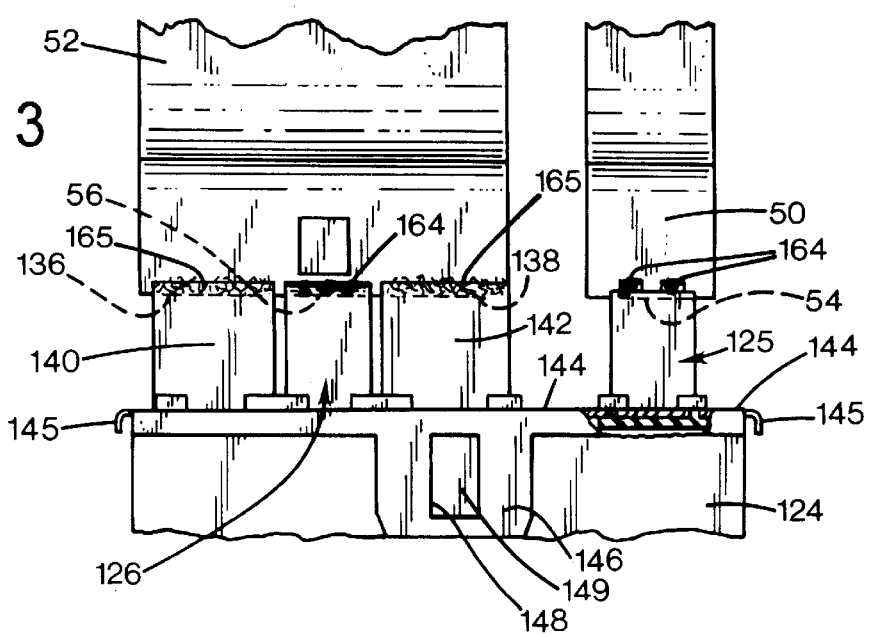
FIG. 3 is an enlarged front elevational view of the service station wipers and flaps, shown just after wiping the printheads.

Some of the earlier wiping systems, described in the Background portion above, wiped across the orifice plate and across areas adjacent the orifice plate, smearing ink along the entire under surface of the printhead. Others wiped only the printhead orifice plate and ignored regions to the sides of the orifice plate. As shown in FIG. 3, the color cartridge 52 has a wider body than the black cartridge 50. The sides of the color cartridge 52 extend straight down to the printhead area, so two wide, flat lands or cheeks 136 and 138 are created to each side of the printhead orifice plate 56. In the earlier printers using this style of cartridge, these cheeks 136, 138 were left unwiped. Unfortunately, the cheeks 136, 138 occasionally accumulated ink particles or residue, then bits of dusts, paper fibers and other debris stuck to this residue. Left unwiped, this cheek debris could then be pulled across the page during printing. If enough debris had accumulated, it could actually smear the printed ink, degrading print quality.

To address the cheek debris issue, the translating service station 100 includes outboard and inboard cheek wiping members, commonly referred to by their designers as "mud flaps" 140, 122, shown in FIG. 3. The mud flaps 140, 142 may be constructed of the same elastomeric material as the wipers 125, 126. Indeed, use of a single type of elastomer for both the wipers 125, 126 and the mud flaps 140, 142 speeds the manufacturing process because the wipers and mud flaps may then be formed in a single molding step. While the wiper blades 128–134 have a curved outboard surface, the preferred configuration tip for the mud flaps 140, 142 is rectangular in cross section, having forward and rearward angular wiping edges.

It is apparent that the wipers 125, 126 and mud flaps 140, 142 may be onsert molded directly onto the pallet wiper support 124, or otherwise attached using a variety of methods known to those skilled in the art. In a preferred embodiment, the wipers and mud flaps are onsert molded onto a sheet of metal, such as a spring steel, which may be bent and formed to provide a removable wiper mount 144, shown in FIG. 3. The wiper mount 144 may start as a long strip of stainless spring steel which is first punched in a flat state to define several of the features of its final construction, including a series of holes extending through the strip in the region under the wipers and mud flaps. These holes are used to onsert mold the wipers 125, 126 and the mud flaps 140, 142 to the upper surface of the mount 144. The wiper mount 144 has two opposing sides which are bent down to form ears 145, while the remaining two opposing sides are bent down to form engagement tabs 146 with slots 148 therethrough. The use of spring steel allows the tabs 146 to expand outwardly over a pair of pallet mounting hooks 149 extending forward and aft of the support 124. The hooks 149 are received within slots 148 to secure the wiper mount 144 to the pallet wiper support 124, as shown in FIG. 3.

As shown in FIG. 2, the other major component supported by the pallet 120, is the capping assembly 150, which includes a raiseable cap support platform or sled 152. The capping assembly 150 has black and color caps 154, 156 for sealing the respective black and color printheads 54, 56. The caps 154, 156 may be joined to the sled 152 by any conventional manner, such as by bonding with adhesives, sonic welding, or more preferably by onsert molding techniques. In the illustrated embodiment, the caps 154, 156 may be of a non-abrasive resilient material, such as an elastomer or plastic, a nitrile rubber or other rubber-like material, but more preferably, caps 154, 156 are of an ethylene polypropylene diene monomer (EPDM), or other comparable material known to those skilled in the art. Suitable black and color caps having the configurations shown for the caps 154, 156 are sold in the DeskJet® 850C, 855C, 820C and 870C models of inkjet printers, produced by the Hewlett-Packard Company of Palo Alto, Calif.

The cap sled 152 may be coupled to the pallet 120 using a pair of pivoting link or yoke members, such as yoke 158, each of which have two upright arms that are pivoted to the cap sled 152. Each yoke is also pivoted to the translating pallet 120. To seal the printheads 54, 56 during periods of printer inactivity, the printhead carriage 40 is moved to a servicing position over the service station 100. To seal the printheads, the pallet 120 is moved forward, toward the left in FIG. 2. As the pallet 120 is moved forward, a group of posts extending upwardly from the sled 152 engage the printhead carriage 40, although these posts could also engage a portion of the pens 50, 52 to accomplish the same result. Further forward motion of the pallet 120 sweeps the sled 152 through an arcuate path, as indicated by curved arrow 160, until the caps 154, 156 engage and seal the orifice plates of printheads 54, 56, respectfully. This arcuate capping motion is achieved because the sled-support arms of the yokes 158 are all of equal length and angular orientation (with respect to pallet 120 and sled 152) to form a shifting parallelogram structure which transports the cap sled 152 between a capping position and a rest or uncapped position. The capping assembly 150 also includes a spring-loaded pivot rocker member 162 that biases the bottom of pallet 120 away from the bottom of the service station base 102 and toward the printheads 54, 56 to provide a suitable capping force for a hermetic seal.

It is apparent that a variety of other types of capping assemblies may be substituted for the illustrated cap assembly 150. It is also apparent to those skilled in the art that a variety of other mechanisms may be used to provide the printhead servicing functions of priming, wiping and capping, in place of the sliding pallet assembly 120 illustrated in FIG. 2. Indeed, a variety of different servicing mechanisms are installed in commercially available inkjet printing mechanisms, many of which may be suitably substituted for the pallet assembly 120. For instance, suitable translating or floating sled types of service station operating mechanisms are shown in U.S. Pat. Nos. 4,853,717 and 5,155,497, both assigned to the present assignee, Hewlett- Packard Company. Since the illustrated mechanism for capping printheads 54 and 56 is not within the subject matter of the claims set forth below, any further detailed description of this mechanism is unnecessary and would only burden the reader.

For conducting the printhead spitting routine, the pallet 120 is retracted toward the rear of the service station frame 102 (to the right in FIG. 2), in what is advantageously used during the servicing routine as a home or rest position. The service station drive motor 105 moves the pallet 120 all the way toward the rear until the rear of the pallet 102 contacts the rear portion of the frame base 102. Once no further rearward motion is accomplished, the logic within the printer controller 36 is reestablished at a zero position. From this zero position, subsequent motor steps are then referenced to locate the pallet 120 at the proper capping, wiping and spitting positions. Upon retracting the pallet 120 to the rest position, the printheads 54, 56 may then be spit into the exposed spittoon 48. In the illustrated embodiment, the interior of the frame base 102 is substantially enclosed to prevent the escape of ink while serving as the spittoon 48 to capture ink spit from pens 50, 52. Preferably, the spittoon 48 has a lower surface, defined by the interior surface of the frame base 102, that may be lined with an absorbent spit pad, which may be of any type of liquid absorbent material, such as of a felt, pressboard, sponge or an open cell foam sponge material.

Fiber Wiper Cleaning System

In FIG. 3, the black and color wipers 125, 126 and the mud flaps 140, 142 are shown just after wiping the printheads 54, 56 and printhead cheeks 136, 138, respectively. Following the wiping stroke, ink residue 164 has accumulated along the tips of the wipers 125, 126, while the mud flaps 140, 142 have accumulated a mixture of other debris 165, which may include ink splatter, paper fibers, lint, dust or other particulate matter. The ink residue 164 on the wipers may include some of this particulate debris, too.

In an earlier service station design, developed by colleagues of the present inventors, all employees of the Hewlett-Packard Company, the present assignee, the service station 100 included a rigid plastic scraper bar, mounted in the same general location as a wiper cleaner mounting member or cleaner bar 166 of the illustrated embodiment. The cleaner bar 166 extends outwardly from a shroud portion 168 of the service station frame bonnet 110, and preferably across a portion of the opening to spittoon 48. To remove ink residue from the wipers and mud flaps the earlier scraper bar had a bottom edge which was lower than the tips of wipers and flaps. Thus, when the pallet moved in a forward direction, the wipers and flaps hit the scraper bar and flicked any excess ink into the front portion of the service station frame. This earlier scraper bar design was more economical that the earlier wiper cleaning mechanisms, such as the service stations sold by the Hewlett-Packard Company in the DeskJet® 850C, 855C, 820C and 870C models of inkjet printers, which required elaborate camming mechanisms, intricate scraper arms, and blotter pads to absorb excess liquids from the inks.

The earlier rigid plastic wiper scraper bar was effective in removing ink residue 164 from the wipers 125, 126 and debris 165 from the mud flaps 140, 142. Unfortunately, this earlier scraper bar design generated a high amplitude, impulsive noise when cleaning the wipers, which some customers complained about as an audible slapping noise or clicking sound. During the process of cleaning the wipers, the rigid scraper bar allowed each wiper blade to build up a large amount of potential energy as the wiper was bent over by contact with the scraper bar. At the point of travel where the wiper was released from under the scraper bar, this potential energy was transferred into a vibration of both the wiper blades and the service station frame, together emitting a loud impulsive noise. Since this noise was undesirable to some customers, and a search began for a new quieter way of effectively cleaning the wipers 125, 126 and mud flaps 140, 142, with a performance which was the same as or better than the earlier scraper bar.

Figure 4:
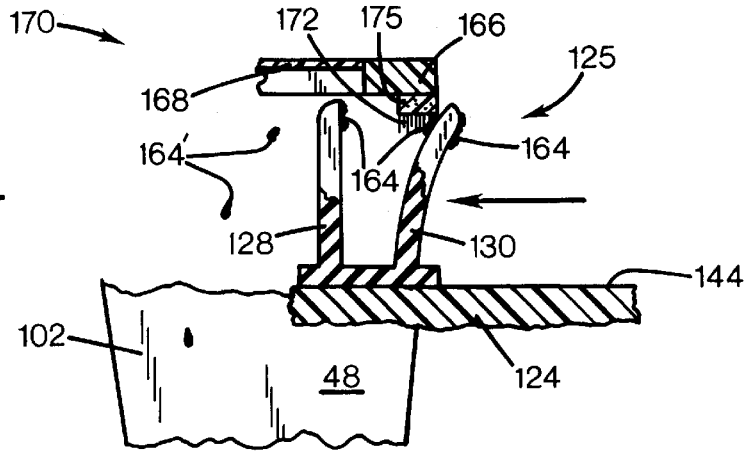
FIGS. 4 and 5 are enlarged side elevational views of one form of a fiber cleaning system of the present invention, taken along lines 4—4 of FIG. 2, here, shown cleaning an inkjet printhead wiper traveling thereunder, first toward the left in FIG. 4, then to the right in FIG. 5.
Figure 5:
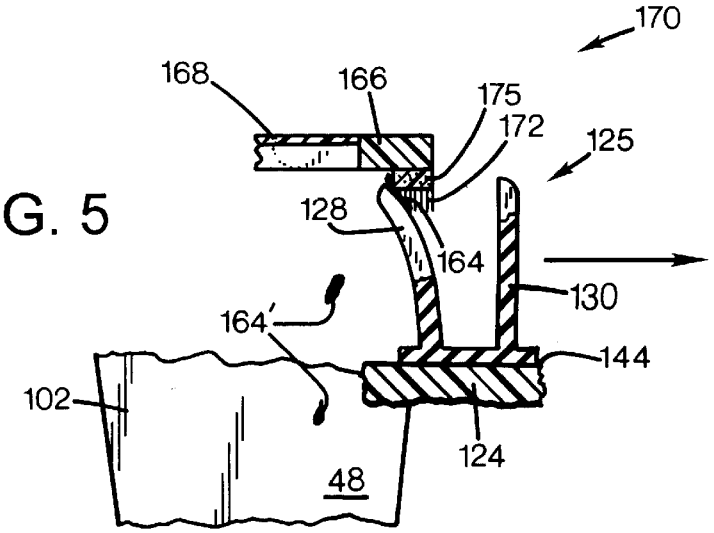

FIGS. 4 and 5 show a first embodiment of a fiber wiper cleaning system 170, constructed in accordance with the present invention. The illustrated cleaner bar 166 portion of system 170 does not extend as far down into the spittoon as the earlier scraper bar did. In FIG. 4, the pallet 120 is shown moving the wipers 125 toward the front (left in FIG. 4) of the service station under the frame shroud 168, whereas FIG. 5 shows the wipers exiting from under the shroud 168 (moving to the right in FIG. 5). The color wiper blades 132, 134 and the mud flaps 140, 142 are omitted from FIGS. 4 and 5 for clarity, and because they experience substantially the same cleaning action as shown for the black wiper blades 128, 130.

Figure 6:
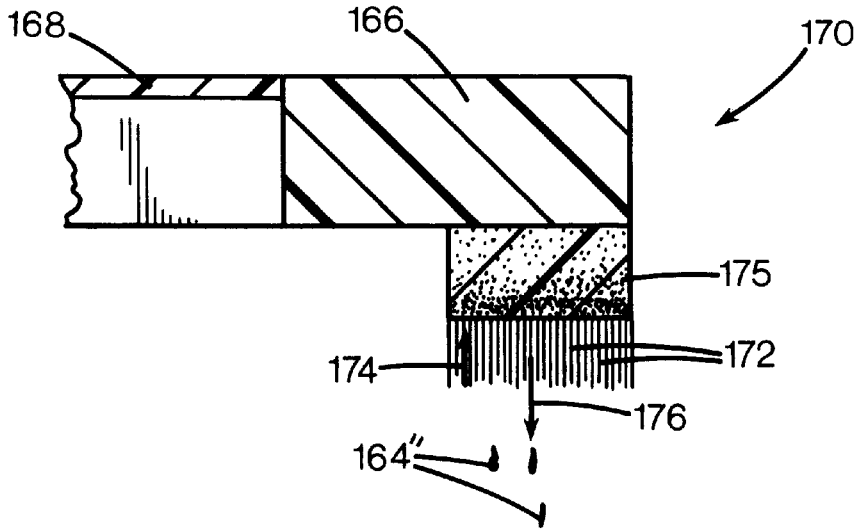
FIG. 6 is a further enlarged side elevational view of the fiber cleaning system of FIGS. 4 and 5.

As best shown in FIG. 6, the cleaning system 170 has a series of flexible elongate cleaning members or fingers, such as the plural elongate straight fibers or bristles 172, extending downwardly from the lower surface of the cleaner bar 166. As the wiper blades 128 and 130 pass through the curtain of bristles 172, debris 164 is removed from the blades through a broom-like sweeping action as the blades progress through successive waves of bristles. The action of moving the wiper blades 128, 130 under the bristles 172 flicks off some of the residue, shown as residue 164', which is then captured in the region of spittoon 48 underneath the shroud 168. Moving the wiper blades 128, 130 under the bristles 172 also provides a pumping action, squeezing the bristles together to force ink residue out from between the bristles.

Liquid ink residue on the bristles 172 may be drawn upwardly through capillary action between closely spaced adjacent bristles 172 arranged to define a capillary passageway therebetween, as shown by arrow 174 in FIG. 6. To assist in drawing the liquid ink residue away from the tips of the bristles 172, an optional absorbent layer 175 may be inserted between the bristles 172 and the cleaner bar 166. The liquid ink residue 164" may also flow downwardly through the force of gravity, indicated by arrow 176 in FIG. 6, where it then drips onto the floor of the spittoon 48. Heavier particulate residue clinging to the bristles may eventually dry and also fall from the bristles onto the spittoon floor.

The bristles 172 may be constructed from a variety of different types of soft organic or man-made bristle material, such as the bristles used commonly on toothbrushes, paint brushes or shoe brushes. For example, one suitable type of bristle material is a polyester. Other suitable types of bristle material are nylon brush fabrics, such as those available from the company of Collins & Aikman, 1803 N. Main, Roxboro, N.C. 27573, and in particular the products sold under the trade names: Brush M (0.190 inch pile); Brush 90 (0.190 inch pile); Brush-Up (0.220 inch pile); and Nylo-Bond (0.190 inch pile).

During prototype testing, a nylon bristled brush, specifically the Brush M product listed above, was used and good results were achieved. Indeed, sound pressure measurements showed that the bristled wiper scraper system 170 realized a greater than 80% amplitude reduction of the impulsive noise compared with the noise experienced using the earlier rigid scraper bar. Moreover, reliability testing has shown the bristled cleaning system 170 generates very little wear on the wiper blades 128–134 and flaps 140, 142, while efficiently removing ink residue and debris 164, 165 to provide a clean wiping surface for the next printhead wiping stroke.

In operation, one preferred method of servicing the printheads 54, 56 may occur upon initial start-up of the printer 20 after a period of printer inactivity. When stored, the pens 50, 52 are capped by the cap assembly 150. Upon start-up the pallet 120 first moves rearwardly (to the right in FIG. 2) to uncap the pens. This rearward motion is continued, which causes the wipers 125, 126 and flaps 140, 142 to wipe the respective printheads 54, 56 and the color pen cheeks 136, 138. Continued rearward motion of the pallet 120 to the home position (extreme right in FIG. 2) then hides the cap assembly 150 under a rear shroud portion 178 of the bonnet 110, leaving the spittoon 48 accessible for spitting, which may be followed by another wiping stroke.

Following uncapping, wiping and spitting, the pens 50, 52 are then free to be transported by carriage 40 to the printzone 25 for printing. Periodically during printing, it may be desirable to return the pens 50, 52 to the service station 45 for spitting followed by a quick wiping routine, accomplished by moving the pallet 120 forward (to the left in FIG. 2) from the rest position. It is apparent that scrubbing or multiple wiping strokes may be easily accomplished by reciprocating the pallet 120 forward and aft while allowing the wipers 125, 126 to stroke and clean the printheads 54, 56. For a return to the inactive state, the pens 50, 52 may be brought back into the servicing region 44, and spit, then wiped clean and capped through a single stroke of forward pallet motion.

Figure 7:
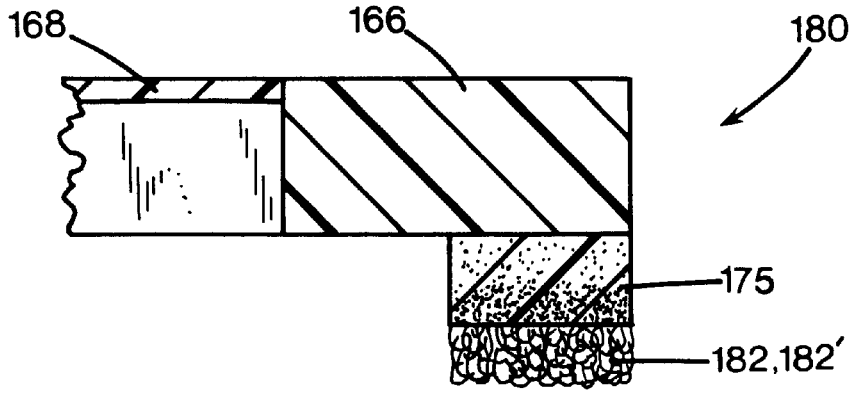
FIG. 7 is an enlarged side elevational view of an alternate embodiment of one form of a fiber cleaning system of the present invention.

FIG. 7 shows an alternate embodiment of a fibrous wiper cleaning system 180 constructed in accordance with the present invention. The system 180 includes the optional absorbent pad 175 attached to the support bar 166. Here, the fibrous wiper cleaning material comprises plural curled and intertwined fibers 182, or alternatively, elongate loops of fibers 182', either embodiment which is substantially illustrated by FIG. 7. In an intertwined plurality of curly fibers 182, the individual fibers may be as described above for bristles 172, but with a curl rather than straight configuration, One example of the configuration for the curly fibers 182 is that of a ScotchBrite® kitchen cleaning pad, manufactured by the 3M (Minnesota Mining and Manufacturing) Company of Minneapolis, Minn., which indeed may be a suitable source of the wiper cleaner fibers 182. One example of a plurality of looped fibers 182' is the loop fastener portion of a hook and loop fabric fastener, such as a Velcro® loop fastener. It is apparent that other types of fibrous material, in addition to the bristles 172, the plastic curly fibers 182 and the threaded loop fibers 182', such as synthetic fibers or metallic fibers, whether straight, bent, curled or looped, may also be used to clean the wipers 125, 126 and optional mud flaps 140, 142. As described above with respect to the bristled fibers 172, adjacent closely spaced fibers define capillary paths between the fibers. These inter-fiber capillary paths also assist in wicking the liquid component of the ink residue away from the distal ends of the fibers, and preferably toward the absorbent pad 175. The resilience of the fibers 182 and 182' also serves to flick some ink residue off of the fibers during the wiping process, as well as letting the larger ink droplets fall under the force of gravity from the fibers.

Figure 8:
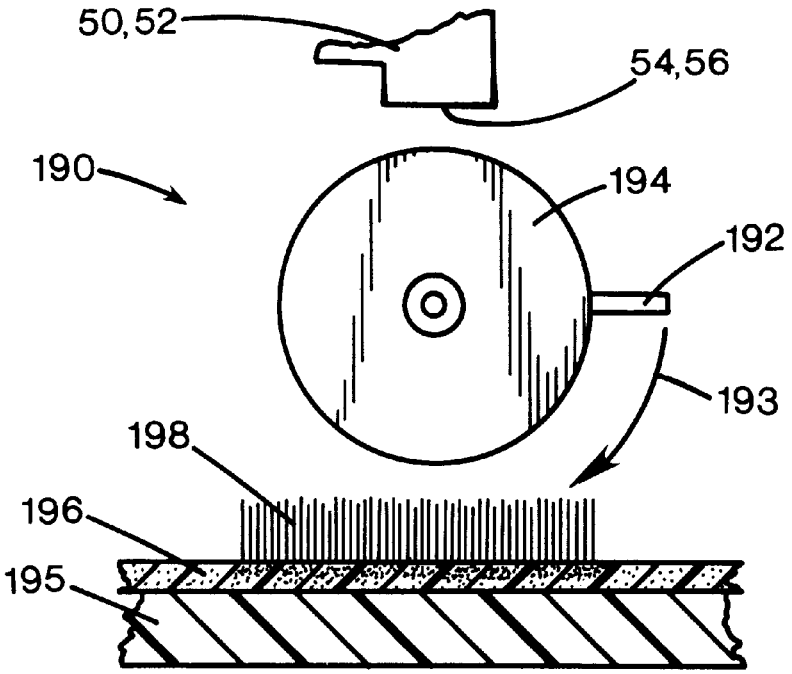
FIG. 8 is a side elevational view of an alternate embodiment of one form of a fiber cleaning system of the present invention, here shown with the wiper mounted on a rotary platform, rather than the translational platform of FIGS. 2–5.

FIG. 8 shows an alternate bidirectional wiper cleaning system 190 constructed in accordance with the present invention as including a rotary wiper 192 mounted for cleaning the printheads 54, 56 in a rotary motion, as indicated by the curved arrow 193, The wiper 192 may be constructed as shown and described above for the wiper assemblies 125, 126, although for simplicity, only one wiper blade 192 is shown schematically in FIG. 8. The wiper 192 is mounted on a tumbler platform 194 which may be coupled to a service station motor, such as motor 105, by a series of conventional gears (not shown) for instance to provide the rotary motion for the wiper 192, as indicated by arrow 193, A cleaner support 195 extends from the service station frame to support an optional absorbent pad 196, which may be of the same materials described above for the pad 175. A plurality of wiper cleaning fibers 198 project upwardly from the support 195, and optionally from the pad 196 if provided, to intersect and clean the surfaces of wiper 192. While the fibers 198 are illustrated as straight bristles, as described above with respect to FIG. 6, it is apparent that the curly fibers 182 or the looped fibers 182' of FIG. 7 may be implemented in the cleaning system 190, as well as their structural equivalents. Commercially available inkjet printers using such a rotary wiping system are currently sold by the Hewlett-Packard Company of Palo Alto, Calif., as the DeskJet® 850C, 855C, 820C and 870C model printers, which may be modified to incorporate the fibrous wiper cleaning system 190.

Figure 9:
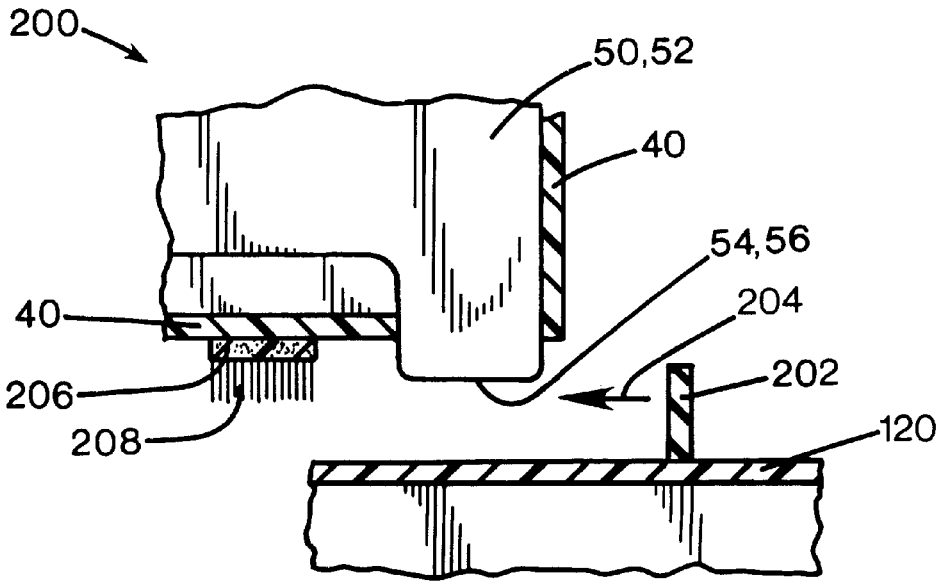
FIG. 9 is a side elevational view of an alternate embodiment of one form of a fiber cleaning system of the present invention, here shown with the wiper cleaner mounted on the printhead carriage.

FIG. 9 shows an alternate wiper cleaning system 200 constructed in accordance with the present invention as including a schematically illustrated upright wiper 202 mounted for translational motion, indicated by arrow 204, to the service station pallet 120. The wiper 202 may be constructed as shown and described above for the wiper assemblies 125, 126. Preferably, the printhead carriage 40 supports an optional absorbent pad 206 from which extend a plurality of fibrous wiper cleaning members 208. While the fiber wiper cleaners 208 are illustrated as straight bristles, as described above with respect to FIG. 6, it is apparent that the curly fibers 182 or the looped fibers 182' of FIG. 7 may be implemented in the cleaning system 190, as well as their structural equivalents. In the carriage-mounted cleaning system 200, the wiper 202 first engages and wipes the printheads as the pallet 120 moves in the direction of arrow 204. After wiping the printhead, the wiper continues as indicated by arrow 204, and into engagement with the fibers 208 of cleaner 200. This motion cleans one side of the wiper 202, while return motion of pallet 120 in a direction opposite arrow 204 cleans the opposing side of the wiper 202 to present a clean wiping surface to the printhead for the last portion of the wiping stroke.

Moreover, while the fibrous cleaning elements 172, 182, 182', 198 and 208 are each shown in side elevational views, it is apparent that rather than being a continuous band of fibers across the entire width of the service station, it may be more preferable if each element was segregated into a smaller width cleaning segment dedicated to cleaning a single wiper assembly 125, 126 and a single flap 140, 142. Separating the cleaning elements 172, 182, 182', 198 and 208 into segments advantageously avoids cross-contamination of ink between the color and black wipers through capillary tracking action along the fibers or through the optional absorbent pads 175, 196, 206. Of course, rather than physically separating the dedicated cleaning segments with merely a space therebetween, it may be desirable in some implementations to insert a moisture impervious barrier between the segments, which may also be instrumental in preventing contamination from ink residue being flicked off of the fibers of one segment and onto the fibers of another segment. These concepts of segregating the cleaning elements 172, 182, 182', 198 and 208 into segments dedicated to cleaning the separate wiper assemblies 125, 126 may be particularly useful where there is some incompatibility during servicing between the chemistries of the different inks dispensed by the printheads 54, 56. For instance, some dye-based color ink compositions and some pigment-based black ink compositions, while producing superior printed images, unfortunately form a jell-like residue when mixed during servicing. This jell-like ink residue has a consistency of drying rubber cement adhesive, and is very difficult to clean from the wipers and/or the printheads. Thus, for inkjet printing mechanisms using inks having incompatible characteristics when inadvertently blended during servicing, the separate servicing of these printheads by all of the service station components is a desired feature easily accomplished by the fibrous wiper cleaning systems 170, 180, 190 and 200.

Conclusion

A variety of advantages are realized using the bristled wiper cleaning systems 170, 180, 190 and 200. For example, the illustrated systems 170 180, 190 and 200 reduce ink build-up, not only on the wipers and flaps, 125, 125, 140, 142, but also on the cleaner fibers 172, 182, 182', 198, 208 through the pumping motion which squeezes the bristles together to push out residue caught between adjacent bristles. Furthermore, the resilient nature of the cleaning fibers 172, 182, 182', 198, 208 presents a softer cleaning surface than the earlier rigid scraper bar, so wiper wear from cleaning the wipers is reduced or eliminated. Finally, the annoying clicking noises experienced when using the earlier rigid scraper bar are reduced by over 80% when the wipers and flaps are cleaned using the bristled wiper cleaning system 170, and similar quieting benefits are also possible using the other fibrous cleaning systems 182, 182', 198, 208 illustrated herein.

We claim:

1. A fiber cleaning system for removing ink residue from a wiper after wiping an inkjet printhead in an inkjet printing mechanism having a chassis, comprising:

a service station supported by the printing mechanism chassis;

a wiper supported by the service station to selectively contact and wipe the printhead to remove any ink residue therefrom; and a fiber cleaner supported by the service station to selectively contact and clean the wiper to remove any ink residue, with the fiber cleaner comprising plural fibers.

2. A fiber cleaning system according to claim 1 wherein the wiper and the fiber cleaner are supported by the service station for relative motion therebetween during a cleaning stroke where at least some of the plural fibers engage the wiper to remove ink residue therefrom.

3. A fiber cleaning system according to claim 2 wherein the wiper and the fiber cleaner are supported by the service station for reciprocal relative motion therebetween during bi-directional cleaning strokes.

4. A fiber cleaning system according to claim 1 wherein:

the service station has a frame;

the fiber cleaner is stationarily supported by the service station frame; and the wiper is movably supported by the service station frame to move through at least some of the plural fibers.

5. A fiber cleaning system according to claim 4 wherein the wiper is supported by the service station frame for bidirectional translational movement relative to the fiber cleaner.

6. A fiber cleaning system according to claim 4 wherein the wiper is supported by the service station frame for rotational movement relative to the fiber cleaner.

7. A fiber cleaning system according to claim 1 wherein the fiber cleaner includes an absorbent member adjacent at least some of the plural fibers to absorb any liquid ink residue.

8. A fiber cleaning system according to claim 7 wherein:

the ink residue has a liquid component; and at least some of the plural fibers are arranged with adjacent fibers located to define a passageway therebetween which draws at least some of the liquid component of the ink residue toward the absorbent member through capillary action.

9. A fiber cleaning system according to claim 1 wherein:

the wiper comprises a blade of a resilient material; and the plural fibers are arranged to be pressed together when in cleaning contact with the wiper blade to force ink residue from between adjacent fibers.

10. A fiber cleaning system according to claim 1 for removing ink residue from two wipers after each has wiped an associated one of two inkjet printheads in the inkjet printing mechanism, wherein the plural fibers are arranged to substantially simultaneously clean the two wipers.

11. A fiber cleaning system according to claim 10 wherein the plural fibers are separated into two groups, with one group of fibers cleaning one of the two wipers, and the other group of fibers cleaning the other wiper.

12. A fiber cleaning system according to claim 1 wherein the plural fibers are substantially elongate bristles.

13. A fiber cleaning system according to claim 1 wherein the plural fibers have a curly configuration.

14. A fiber cleaning system according to claim 1 wherein at least some of the plural fibers are intertwined.

15. A fiber cleaning system according to claim 1 wherein the plural fibers comprises a plurality of loops.

16. A fiber cleaning system according to claim 1 wherein the plural fibers are of a loop fastener portion of a hook and loop fabric fastener.

17. A fiber cleaning system according to claim 1 wherein:

the service station has a frame;

the wiper and the fiber cleaner are supported by the service station frame for reciprocal translational relative motion therebetween during bidirectional cleaning strokes where at least some of the plural fibers engage the wiper to remove ink residue therefrom;

the wiper comprises a blade of a resilient material;

the plural fibers are arranged to be pressed together when in cleaning contact with the wiper blade to force ink residue from between adjacent fibers; and the fiber cleaner includes an absorbent member adjacent at least some of the plural fibers to absorb any liquid ink residue.

18. An inkjet printing mechanism for printing an image, comprising:

a chassis;

an inkjet printhead that accumulates ink residue while printing the image;

a service station supported by the chassis;

a wiper supported by the service station to selectively contact and wipe the printhead to remove ink residue therefrom; and a fiber cleaner supported to selectively contact and clean the wiper to remove any ink residue, with the fiber cleaner comprising plural fibers supported by the service station.

19. An inkjet printing mechanism according to claim 18 wherein:

the wiper comprises a blade of a resilient material; and the plural fibers are arranged to be pressed together when in cleaning contact with the wiper blade to force ink residue from between adjacent fibers.

20. An inkjet printing mechanism according to claim 18 wherein:

the inkjet printing mechanism further includes a carriage that reciprocated the printhead for printing and servicing; and the plural fibers are supported by the printhead carriage.

21. An inkjet printing mechanism according to claim 18 wherein the wiper is supported by the service station frame for translational movement relative to the fiber cleaner.

22. An inkjet printing mechanism according to claim 18 wherein the wiper is supported by the service station frame for rotational movement relative to the fiber cleaner.

23. An inkjet printing mechanism for printing an image, comprising:

a chassis;

an inkjet printhead that accumulates ink residue while printing the image;

a service station supported by the chassis, wherein the service station has a frame;

a wiper supported by the service station to selectively contact and wipe the printhead to remove ink residue therefrom; and a fiber cleaner supported to selectively contact and clean the wiper to remove any ink residue with the fiber cleaner comprising plural fibers, wherein the fiber cleaner is stationarily supported by the service station frame;

wherein the wiper is movably supported by the service station frame to move through at least some of the plural fibers.

* * * * *